US011125190B2

(12) United States Patent
Kuske et al.

(10) Patent No.: US 11,125,190 B2
(45) Date of Patent: Sep. 21, 2021

(54) METHODS AND SYSTEM FOR AN ENGINE SYSTEM

(71) Applicant: Ford Global Technologies, LLC, Dearborn, MI (US)

(72) Inventors: Andreas Kuske, Geulle (NL); Hans Guenter Quix, Herzogenrath (DE); Christian Winge Vigild, Aldenhoven (DE); Paul Turner, Chelmsford (GB); Adrian Butcher, Chelmsford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/867,988

(22) Filed: May 6, 2020

(65) Prior Publication Data

US 2020/0355143 A1 Nov. 12, 2020

(30) Foreign Application Priority Data

May 6, 2019 (DE) ..... 102019206448.5

(51) Int. Cl.

| | |
|---|---|
| ***F02M 26/28*** | (2016.01) |
| ***F02M 26/25*** | (2016.01) |
| ***F02M 26/33*** | (2016.01) |
| ***F02M 26/30*** | (2016.01) |
| ***F02M 26/32*** | (2016.01) |

(52) U.S. Cl.

CPC ..... *F02M 26/28* (2016.02); *F02M 26/25* (2016.02); *F02M 26/30* (2016.02); *F02M 26/32* (2016.02); *F02M 26/33* (2016.02)

(58) Field of Classification Search

CPC ..... F02M 26/28; F02M 26/25; F02M 26/33; F02M 26/30; F02M 26/32; F02M 31/042; F02M 26/06; F02B 29/0406; F02B 29/0475; F02B 29/0493

See application file for complete search history.

(56) References Cited

U.S. PATENT DOCUMENTS

| | | | | |
|---|---|---|---|---|
| 5,937,651 | A * | 8/1999 | Braun | F02B 37/007 60/605.2 |
| 8,015,822 | B2 | 9/2011 | Ranasinghe et al. | |
| 8,690,166 | B2 | 4/2014 | Peota et al. | |
| 9,309,801 | B2 * | 4/2016 | Jayakar | F01P 7/16 |
| 9,605,587 | B2 | 3/2017 | Cunningham et al. | |
| 2010/0095941 | A1 * | 4/2010 | Auffret | F02M 26/08 123/568.12 |
| 2013/0219886 | A1 * | 8/2013 | Koch | F02M 26/24 60/605.2 |
| 2014/0358404 | A1 * | 12/2014 | Lavertu | F02B 37/013 701/105 |
| 2017/0002773 | A1 | 1/2017 | Segawa | |

(Continued)

FOREIGN PATENT DOCUMENTS

| | | | |
|---|---|---|---|
| DE | 10211167 | A1 | 9/2002 |
| DE | 102004011266 | A1 | 9/2005 |
| DE | 60220301 | T2 | 9/2007 |

*Primary Examiner* — Xiao En Mo

(74) *Attorney, Agent, or Firm* — Geoffrey Brumbaugh; McCoy Russell LLP

(57) ABSTRACT

Methods and systems are provided for a cooling arrangement of an engine. In one example, a method comprises flowing coolant from a high temperature coolant circuit or a low temperature coolant circuit to a fresh air heat exchanger in response to a condensate likelihood.

20 Claims, 6 Drawing Sheets

(56) References Cited

U.S. PATENT DOCUMENTS

| | | | | |
|---|---|---|---|---|
| 2017/0022940 | A1 | 1/2017 | Minami et al. | |
| 2017/0306908 | A1 | 10/2017 | Serrecchia | |
| 2018/0023457 | A1 | 1/2018 | Kimura et al. | |
| 2019/0120118 | A1* | 4/2019 | Son | F01P 3/20 |

* cited by examiner

METHODS AND SYSTEM FOR AN ENGINE SYSTEM

CROSS REFERENCE TO RELATED APPLICATIONS

The present application claims priority to German Patent Application No. 102019206448.5 filed on May 6, 2019. The entire contents of the above-listed application is hereby incorporated by reference for all purposes.

FIELD

The present description relates generally to adjusting coolant flow to change a temperature of fresh air.

BACKGROUND/SUMMARY

The requirements for internal combustion engines of motor vehicles with respect to efficiency and pollutant emissions are becoming ever stricter. One measure for reducing pollutant emissions is so-called exhaust gas recirculation (EGR), in which part of the exhaust gas stream leaving the engine is diverted through an EGR line and returned to the engine together with aspirated fresh air. In many cases, exhaust gas recirculation takes place under specific conditions, e.g. with a sufficiently heated engine. In some countries however, it will be prescribed that such exhaust gas recirculation is also performed with a cold engine, e.g., during a cold start. In particular for low-pressure EGR systems, low temperatures may lead to condensation of moisture which may be contained in the recirculated exhaust gas or supplied fresh air, since the temperature lies below the dew point. In the case of a charged engine, condensation or even ice formation may occur before or in the region of the compressor, whereby blades of the compressor may be degraded due to contact with condensate droplets. Examples for mitigating condensate formation include heating intake air via a coolant circuit, however, these examples typically utilize the coolant once the engine is outside of the cold-start.

However, the temperature of the corresponding coolant on cold start lies in the region of the ambient temperature, so effective heating may not be achieved in this way. Another example solution to heat the aspirated fresh air or the mixture of fresh air and recirculated exhaust gases with an electric heating element. The electric heating element is however technically complex and extremely inefficient, in particular from an energy aspect. Furthermore, the electric heating element increases a packaging constraint.

U.S. 2017/0306898 A1 describes an engine system with a charged engine, a high-pressure EGR system and a low-pressure EGR system. The intake air is produced by merging exhaust gases from the low-pressure EGR system and aspirated fresh air. A low-pressure EGR cooler is arranged in a line of the low-pressure EGR system. If the temperature of the ambient air lies below the dew point, coolant is supplied from an engine cooling circuit to the low-pressure EGR cooler, in order to block excessive cooling of the exhaust gases passing through the latter. This aims to block condensation occurring in the intake air.

U.S. Pat. No. 8,015,822B2 discloses a method for reducing a probability of liquid product formation in an exhaust gas stream generated by a turbomachine. The turbomachine has an inlet branch heat system for increasing a temperature of an inlet fluid comprising an inlet air and an exhaust gas stream, wherein the inlet air branch heat system has at least one valve and a compressor which receives and compresses an inlet fluid from the inlet system. In the method, the inlet branch heat system is used to increase a temperature of the inlet fluid via a condensation temperature, and modulate an EGR flow control device in order to adapt a flow rate of the exhaust gas stream.

U.S. Pat. No. 8,960,166 B2 discloses a method for operating a cooling circuit of a charged internal combustion engine in which the heat supply to a precompressor line is set depending on a temperature in the wall of the precompressor line. If it is found that the temperature lies below a dew point temperature, a temperature increase may be achieved via an electric heating element in the wall or by the supply of a coolant to the wall.

U.S. 2017/0002773 A1 discloses a charged internal combustion engine in which an EGR device introduces returned exhaust gas into a supply line at a position upstream of the compressor. A collection pocket is arranged on the outer periphery of the compressor inlet, and is configured to capture condensation water forming in an inlet line upstream of the compressor. The collection pocket opens in the direction upstream of the compressor and is formed as a ring. It is provided that condensation water in the collection pocket gradually evaporates when the compressor is sufficiently heated.

U.S. Pat. No. 9,605,587 B2 discloses a charged internal combustion engine with exhaust gas recirculation. A control unit determines whether liquid condensation can occur in the region of a charge air cooler. If so, heated coolant from an engine cooling circuit is supplied to the charge air cooler in order to suppress the condensation. The system also checks whether the coolant temperature is sufficiently high, otherwise no supply to the charge air cooler takes place. In this case, the charge air cooler may be heated by an electric heat source.

U.S. 2017/0022940 A1 describes an engine in which an intake line has a charge air cooler arranged downstream of a compressor. An EGR line is provided with an EGR valve and an EGR cooler. A control unit determines the generation of condensation water in the EGR cooler, the generation of condensation water in a mixing portion in which fresh air and recirculated exhaust gas are merged, and the generation of condensation water in the charge air cooler. If generation of condensation water is established in one of these portions, the control unit initiates corresponding counter-measures.

U.S. 2018/0023457 A1 discloses a cooling system for an internal combustion engine. Several connecting lines connect an engine cooling circuit to a charge air cooler cooling circuit. A coolant supply line is connected on one side downstream of a mechanical pump and upstream of a main cooler of the engine cooling circuit, and on the other side downstream of a secondary cooler and upstream of an electric pump of the charge air cooling circuit. A coolant drainage line is connected on one side downstream of the electric pump and upstream of the auxiliary cooler, and on the other side downstream of the mechanical pump and upstream of the main cooler. A charge air cooler cooling circuit valve is arranged in the inflow line.

In view of the previous examples, the avoidance of condensation in charged engines with exhaust gas recirculation leaves room for improvements. In particular, a structurally simple and energy-efficient solution is desirable. The present disclosure is based on allowing an energy-efficient avoidance of condensation in a charged engine with exhaust gas recirculation.

In one example, the issues described above may be addressed by an engine system with an internal combustion engine, an intake line comprising a fresh air heat exchanger, an exhaust gas recirculation line opening into the intake line upstream of a compressor and downstream of the fresh air heat exchanger, and a charge air cooler arranged downstream of the compressor, wherein the charge air cooler is fluidly coupled to the fresh air heat exchanger via a first connecting line, and wherein the charge air cooler flow coolant through the first connecting line to the fresh air heat exchanger via a first valve, a second valve, and a third valve.

As one example, a mode of a plurality of operating modes may be selected based on one or more of an engine temperature and a condensate likelihood. The plurality of operating modes may adjust coolant flow to a fresh air heat exchanger configured to thermally communicate coolant and fresh air without mixing the two. The coolant may be delivered from a high temperature coolant circuit or a low temperature coolant circuit based on the engine temperature, in one example.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

Further advantageous details and effects of the disclosure are explained in more detail below with reference to exemplary embodiments shown in figures. The drawing shows.

DETAILED DESCRIPTION

Figure 1:
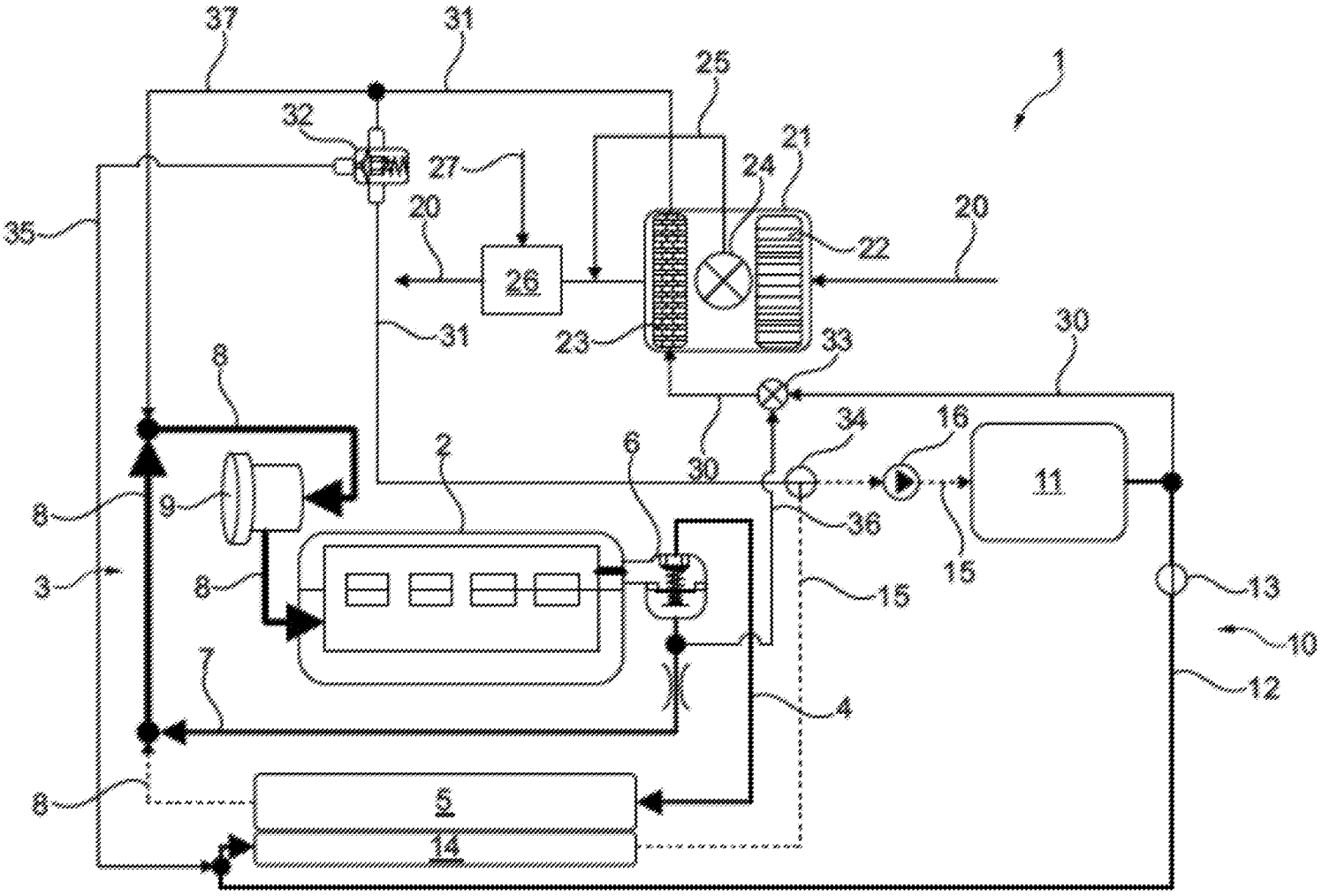
FIG. 1 shows an embodiment of an engine system according to the present disclosure in a standard mode.
Figure 2:
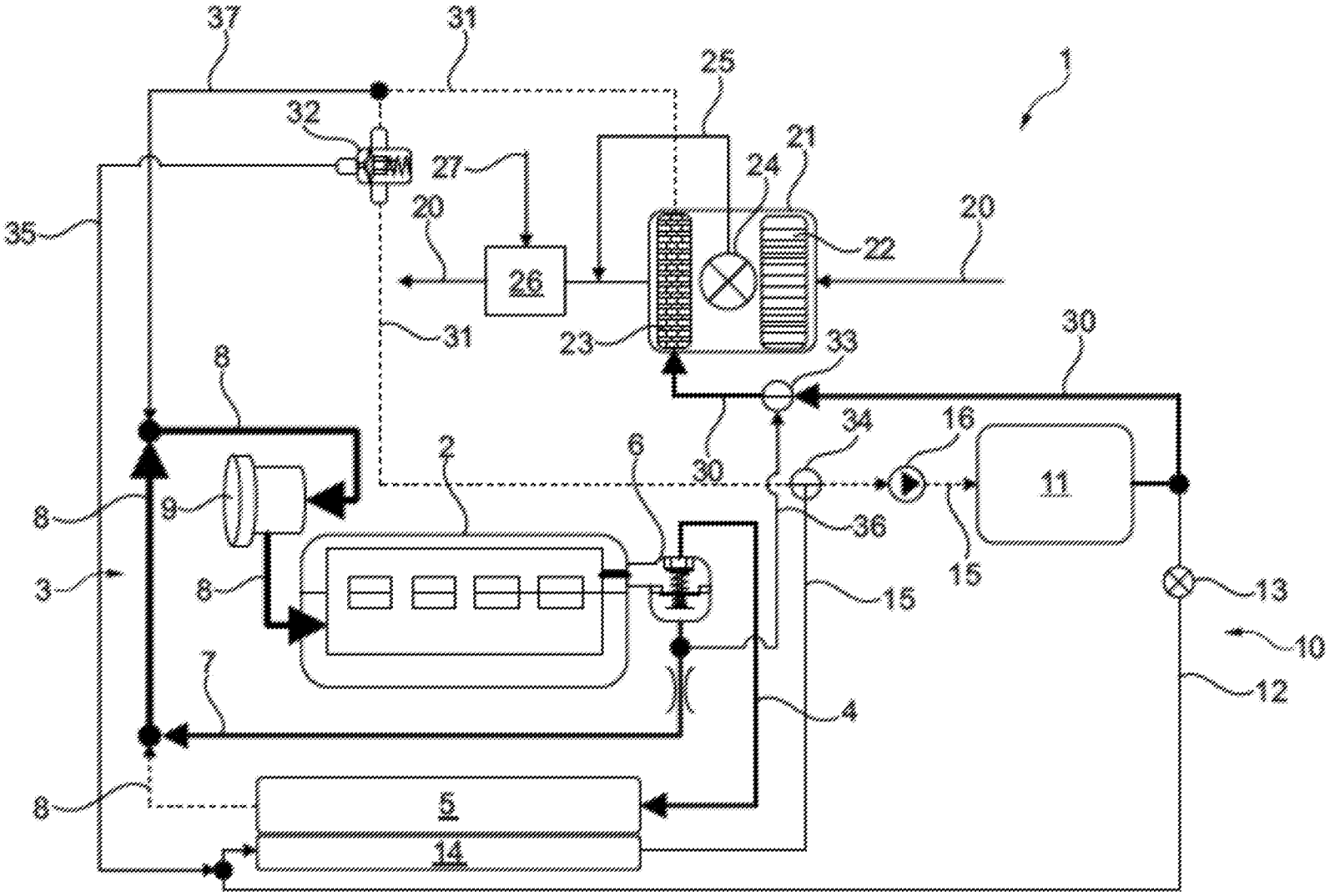
FIG. 2 shows the engine system in a low-temperature heating mode, in a first state.
Figure 3:
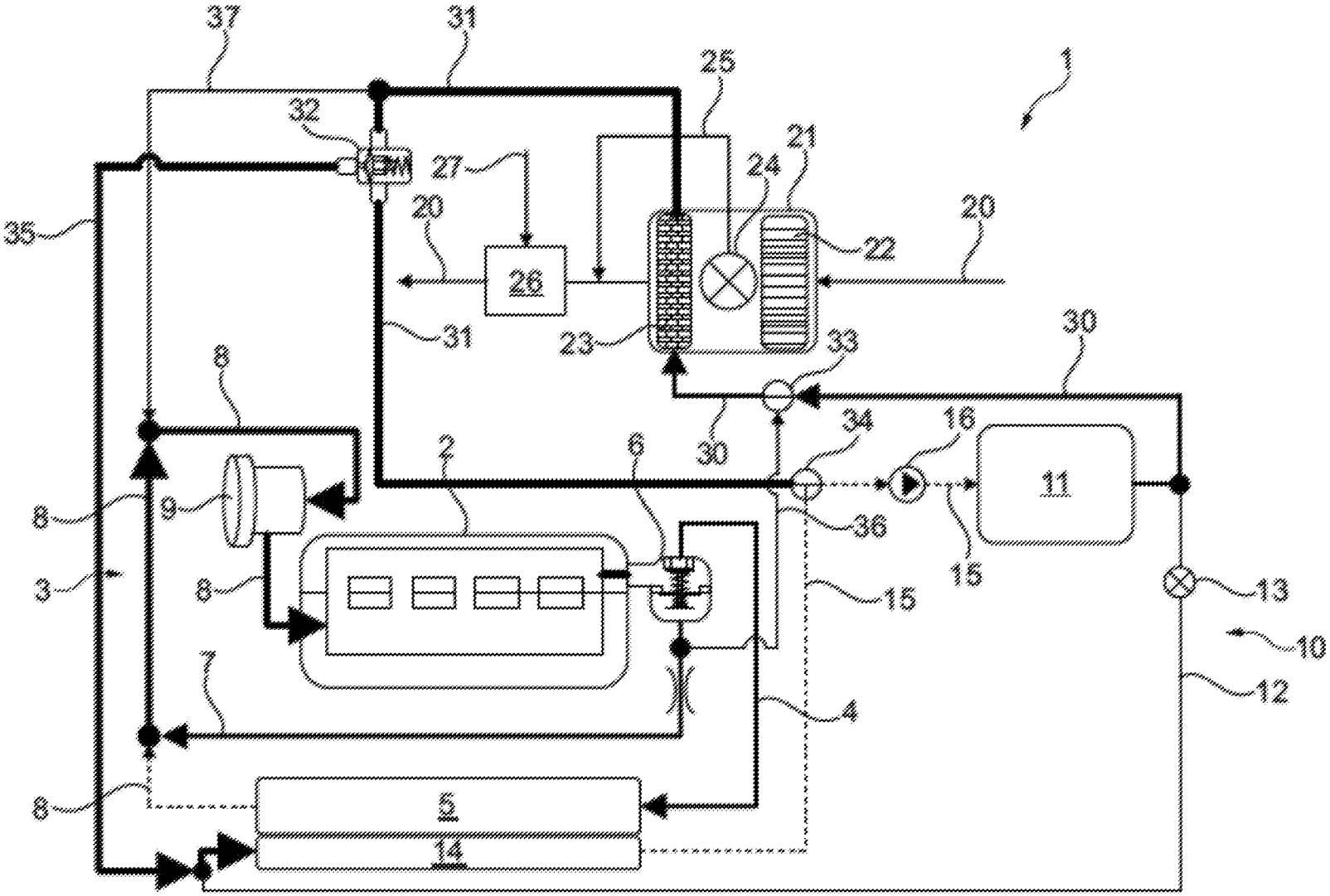
FIG. 3 shows the engine system in a low-temperature heating mode, in a second state.
Figure 4:
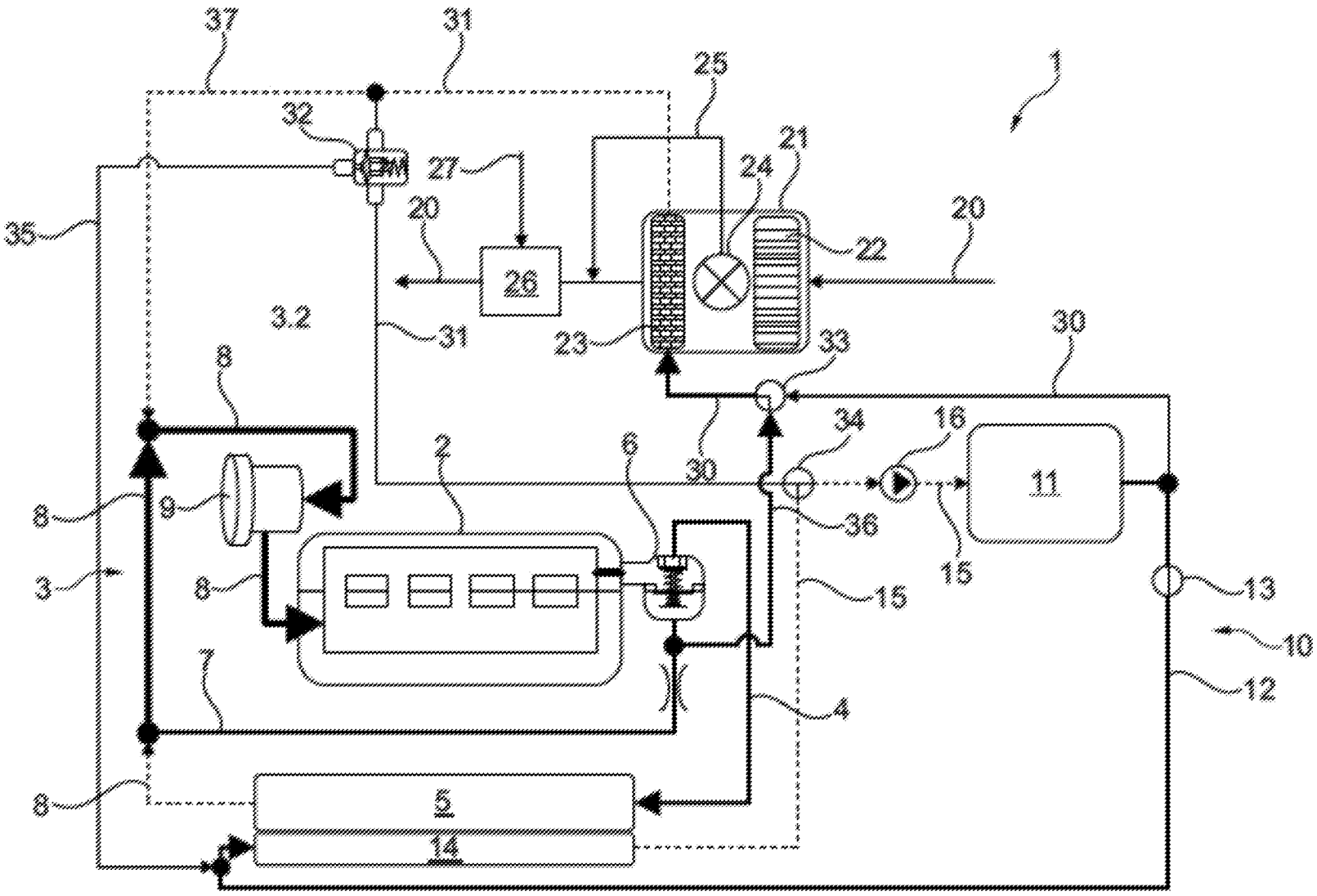
FIG. 4 shows the engine system in a high-temperature heating mode.
Figure 5:
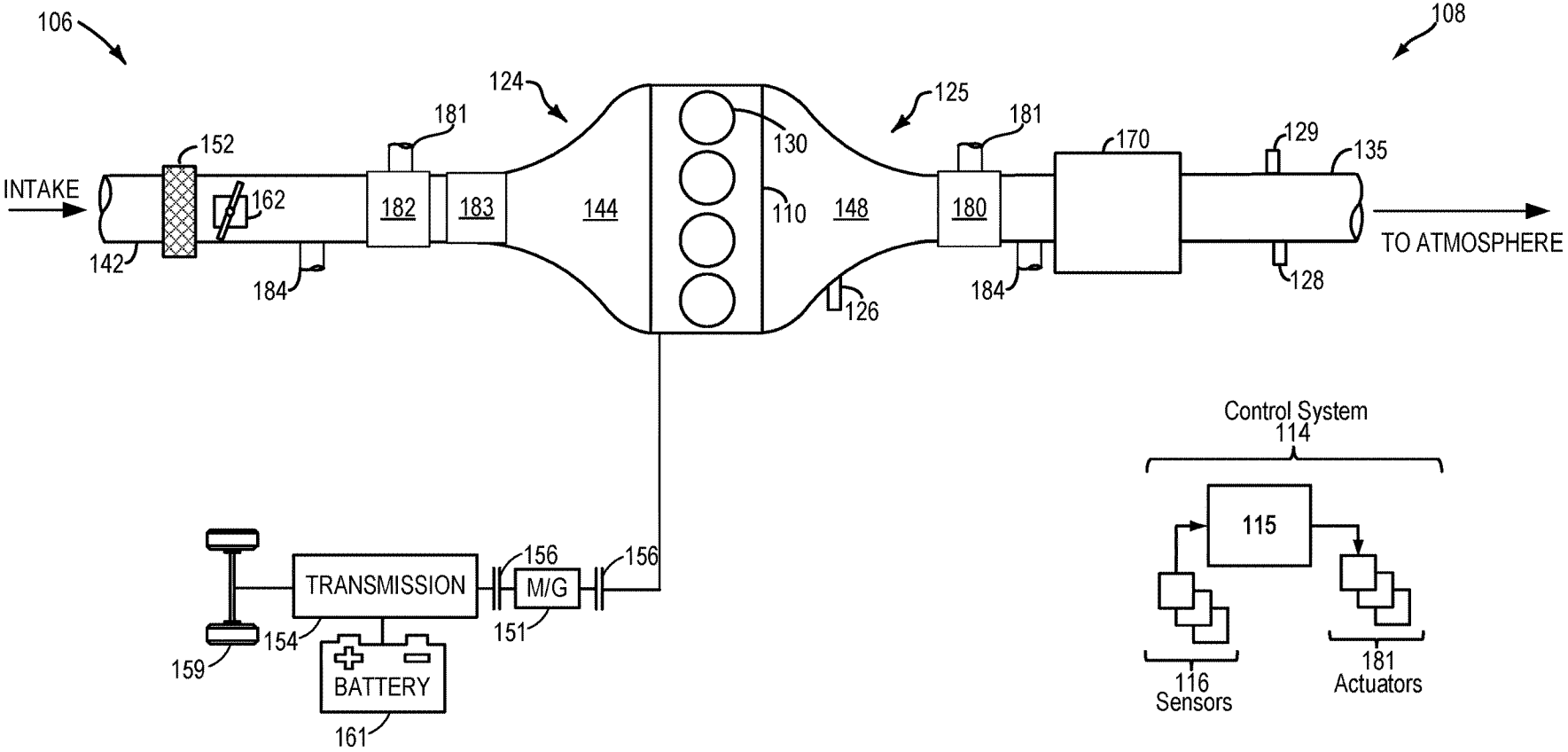
FIG. 5 shows an engine of a hybrid vehicle.
Figure 6:
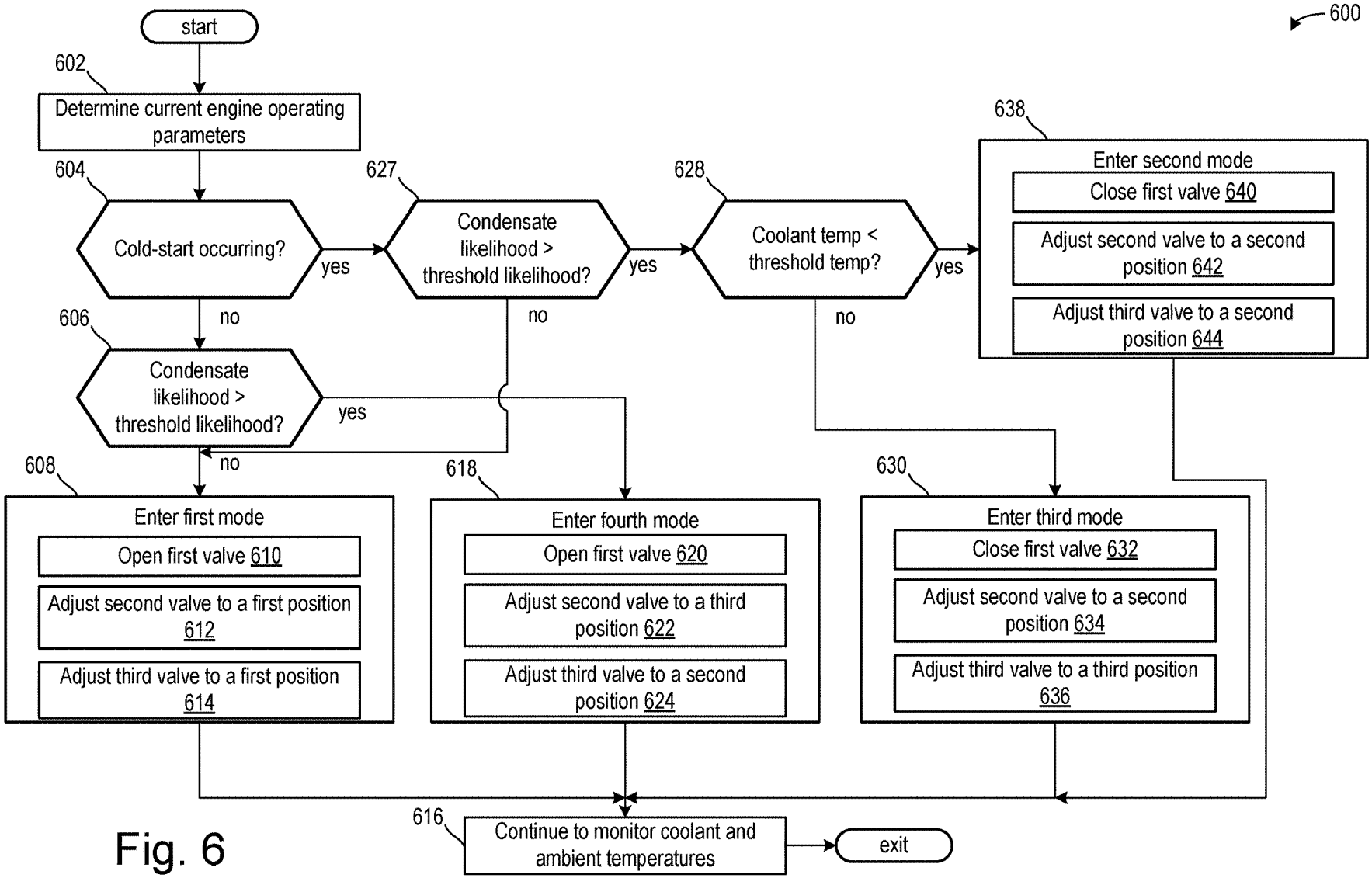
FIG. 6 shows a method for selecting between the low- and high-temperature heating modes.

The following description relates to systems and methods for an engine. FIG. 1 shows an embodiment of an engine system according to the present disclosure in a first mode. FIG. 2 shows the engine system in a second mode. FIG. 3 shows the engine system in a third mode. FIG. 4 shows the engine system in a third mode. FIG. 5 shows an engine of a hybrid vehicle. FIG. 6 shows a method for selecting between the modes based on a condensate likelihood and an engine temperature.

In one example, the present disclosure provides an engine system with an internal combustion engine. The internal combustion engine may in particular be a petrol engine or a diesel engine of a motor vehicle. More precisely, the internal combustion engine may be described as a charged internal combustion engine. The term "engine system" here refers to various components which belong to the internal combustion engine or which allow or support its function.

The engine system has an intake line which has a fresh air heat exchanger for tempering fresh air. The term "line" here and below refers to at least one component, in some cases, several components, which is/are configured to guide or conduct a fluid.

Insofar as a line is mentioned, this in itself is may be unbranched, which does not exclude the possibility that other lines may branch off or open into this. Each line may comprise a plurality of separately produced portions connected together. The cross-section of a line may be constant or may also vary in portions. A line may be configured as a tube, so that a length thereof amounts to a multiple of a cross-sectional dimension, but it may also for example comprise a type of chamber which has comparable dimensions in all directions. In general, the wall of the corresponding line is sealed against the fluid. The intake line serves to draw in fresh air from the environment and conduct the aspirated fresh air or intake air in the direction of the internal combustion engine. It has a fresh air heat exchanger which is configured for tempering fresh air.

The fresh air heat exchanger is configured as a liquid-gas heat exchanger and is designed to conduct in its interior a liquid coolant (e.g. a water-glycol mixture) which can exchange heat with the fresh air, whereby a temperature change of the fresh air takes place. In general, it is provided that the fresh air is heated. To this extent, the fresh air heat exchanger may also be regarded as a heating element. In particular, it may be arranged on or in the region of an air filter. More precisely, the fresh air heat exchanger may be arranged at least partially together with an air filter in an air filter housing inside the intake line. Such an air filter housing, which could partially also be described as an airbox, under certain circumstances also serves to calm the air flow of the aspirated fresh air. In one example, an embodiment of the present disclosure comprises an "air cleaner with integrated heating core" (ACIHC), wherein the fresh air heat exchanger acts as a heating element.

Furthermore, the engine system has an exhaust gas recirculation line opening into the intake line upstream of a compressor and downstream of the fresh air heat exchanger. The position at which the exhaust gas recirculation line opens is thus downstream of the fresh air heat exchanger but upstream of the compressor. The terms "upstream" and "downstream" here and below relate to the normal and prescribed flow direction of the fluid inside the respective line or component during operation of the engine system. The compressor may be included in a turbocharger which serves to generate charge air by compression before it is supplied to the internal combustion engine.

In this context, it will become clear below that the composition of the charge air may in general differ from the aspirated fresh air. The compressor is coupled via a common shaft to a turbine which itself is driven by the exhaust gas stream from the internal combustion engine. In other words, the turbine is arranged in an exhaust gas line which may comprise various further elements e.g. catalysts. The exhaust gas recirculation line, which is also referred to below as the EGR line, branches off the exhaust gas line and returns part of the exhaust gases so that these are supplied back to the internal combustion engine. This is achieved in that the EGR line opens into the intake line upstream of the compressor. Thus charge air is generally formed from intake air, which is a mixture of aspirated fresh air and recirculated exhaust gases. The intake line however conducts fresh air upstream of the opening of the EGR line where the fresh air heat exchanger is arranged. It is evident that the recirculated exhaust gases may already have been catalytically treated before entering the EGR line or also inside said line. An exhaust gas recirculation valve (EGR valve) may be provided which influences the exhaust gas flow through the EGR line. Such an exhaust gas recirculation valve may be provided at the point at which the exhaust gas recirculation line opens into the intake line, in one example.

In addition, the engine system has a charge air cooler arranged downstream of the compressor. The charge air cooler serves for tempering, usually cooling, the charge air which has been heated because of compression in the compressor. In other words, inside the charge air cooler, a temperature (or temperature range) of the charge air is set with which it can be supplied to the internal combustion engine without problems.

The charge air cooler, in one example, is a liquid-gas heat exchanger which is configured to conduct a liquid coolant. The indirect contact between the coolant and the charge air leads to a cooling of the latter.

According to the disclosure, the charge air cooler is connected to the fresh air heat exchanger via a first connecting line, and at least one valve can be adjusted in order to open a coolant flow through the first connecting line to the fresh air heat exchanger in a low-temperature heating mode. The connection between the charge air cooler and the fresh air heat exchanger exists via the first connecting line, which in particular includes the possibility that the first connecting line is connected directly both to the charge air cooler and also to the fresh air heat exchanger. As an alternative to the direct connection, the first connecting line may also be connected indirectly to the charge air cooler and/or fresh air heat exchanger via an intermediate line or an intermediate line portion. Coolant may be transferred from the charge air cooler to the fresh air heat exchanger via the first connecting line.

In this context, the coolant is at least mainly liquid, which includes the possibility that certain amounts of gaseous substances, which could make a proportional contribution to heat transfer, are conducted inside the first connecting line. At least one valve is adjustable in order to open a coolant flow to the fresh air heat exchanger through the first connecting line in a low-temperature heating mode. It is evident that the coolant flow in the respective cooling circuit is generated by at least one pump, which may either be coupled as a mechanical pump to the internal combustion engine or optionally can be operated as an electric pump e.g. via a vehicle battery. In order to open the coolant flow, at least one valve is arranged inside the first connecting line. As well as opening and blocking the coolant flow, the at least one valve may also be configured to quantitatively influence the coolant flow, i.e. the coolant flow may be variable in stages or steplessly. That is to say, the valve may comprise a fully closed position where flow is completely blocked, a fully open position where flow is completely unblocked, and a plurality of positions therebetween.

The valves mentioned here and below may be controlled by a control unit (e.g., a controller). The corresponding control unit is configured to actuate at least one of said valves. The above-mentioned at least one pump can also be actuated via the control unit. The control unit is configured to actuate the at least one valve in order to open or close the above-mentioned coolant flow. The control unit may be integrated in the at least one valve, or it may be an external control unit which is connected to the at least one valve via suitable control lines. The control unit may in some cases comprise a plurality of mutually spaced components. The control unit may be implemented at least partially by software. Furthermore, the control unit may be implemented partially by a device which fulfils other functions as well as controlling the at least one valve. In one example, the control unit is a controller with instructions for adjusting the valve in response to conditions stored on non-transitory memory thereof. The controller may signal to an actuator of the valve to open or close the valve in response to the conditions sensed via sensors of the engine system.

In the low-temperature heating mode, coolant which has flowed through the charge air cooler is conducted to the fresh air heat exchanger. As already described, the charge air is heated in the compressor and usually cooled in the charge air cooler. This applies, for example, at low exterior temperatures and on cold start, the internal combustion engine still has a comparatively low temperature relative to engine conditions outside of the cold-start and low ambient temperatures. The temperature of the charge air on entering the charge air cooler is at least to a certain extent independent thereof. The charge air thus to a certain extent constitutes a directly available heat source which, according to the disclosure, is used to transfer heat to the fresh air heat exchanger. This takes place via the coolant which flows through the first connecting line. In particular, at low ambient temperatures, on reaching the fresh air heat exchanger, the charge air still has a significantly higher temperature than the fresh air, i.e. the aspirated ambient air. This is heated therefore by contact with the fresh air heat exchanger. When the aspirated fresh air is combined downstream with the exhaust gases from the exhaust gas recirculation line, there is at least a high probability that the temperature of the resulting gas mixture, i.e. the intake air, lies above the dew point of water. Thus no condensation of moisture or no ice formation occurs which could degrade the downstream compressor.

The solution according to the present disclosure for avoiding such undesirable condensation is structurally simple, and in particular extremely energy-efficient since no additional electric heating elements are needed.

In principle, all aspirated fresh air may be conducted along or through the fresh air heat exchanger. Under some circumstances, it may however also be advantageous if at least part of the aspirated fresh air is not heated for part of the time. According to a corresponding embodiment, a fresh air bypass line bypassing the fresh air heat exchanger is connected to the intake line upstream and downstream thereof, wherein an air flow ratio between the intake line and the fresh air bypass line can be influenced by at least one fresh air bypass valve. The fresh air bypass line is evidently configured, like the intake line, to conduct fresh air. It is connected to the intake line firstly upstream and secondly downstream of the fresh air heat exchanger, such that it branches off the intake line upstream of the fresh air heat exchanger and opens into the intake line again downstream thereof. In other words, air flowing through the fresh air bypass line bypasses the fresh air heat exchanger. An air flow ratio between the intake line and the fresh air bypass line can be influenced by at least one fresh air bypass valve. The air flow ratio is the ratio of air flow in the fresh air bypass line firstly and in the intake line secondly. The fresh air bypass valve may perform widely varying functions. For example, it may be configured to optionally block or open the fresh air bypass line. Alternatively or additionally, it may be configured to optionally block or open the portion of the intake line which is bypassed by the fresh air bypass line. In addition, a quantitative change in opening state of the fresh air bypass line and/or intake line is possible, so that at least one of said lines can also be partially opened.

According to a further embodiment, the charge air cooler is connected to a low-temperature heat exchanger via a first low-temperature line, wherein at least one valve can be adjusted in order to reduce a coolant flow from the charge air cooler to the low-temperature heat exchanger in the low-temperature heating mode. In this context, the term "low-temperature" should not be interpreted restrictively, although maximum coolant temperatures in the components described as "low-temperature" in operating state are generally lower than the maximum temperatures in the components described as "high-temperature". The low-temperature heat exchanger and the first low-temperature line can be described as parts of a low-temperature cooling circuit, in which coolant heated at the charge air cooler can be cooled at the low-temperature heat exchanger. This cooled coolant may be returned to the charge air cooler via a second low-temperature line. In low-temperature heating mode, it is provided that the heat supplied to the coolant in the charge air cooler is used in particular to heat the fresh air in the intake line. From this aspect, it is advantageous if in any case a small proportion of the heated coolant is supplied to the low-temperature heat exchanger where it cannot contribute to heating the fresh air. The coolant flow from the charge air cooler to the low-temperature heat exchanger is to this extent at least reduced, optionally fully suppressed. The term "reduced" should be regarded in relation to a maximum quantity of heat flow which can be achieved by other settings of the at least one valve. Normally, this possible maximum quantity is set in the standard mode explained in more detail below. The above-mentioned control unit may be configured to actuate the at least one valve in order to set it as described.

Optionally, the fresh air heat exchanger is connected to the charge air cooler downstream via a second connecting line, and at least one valve can be adjusted in order to open a coolant flow to the charge air cooler through the second connecting line in the low-temperature heating mode. Again, the second connecting line may be connected directly to both the fresh air heat exchanger and to the charge air cooler. Alternatively, an indirect connection via an intermediate line or line portion would be conceivable. To a certain extent, the second connecting line supplements the first connecting line, so that at least when at least one valve is suitably set, a cooling circuit exists between the charge air cooler and the fresh air heat exchanger. It is understood that the coolant in the second connecting line, because of the heat dissipation in the fresh air heat exchanger, generally has a lower temperature than the coolant in the first connecting line. Insofar as both the second connecting line and the second low-temperature line serve to supply coolant to the charge air cooler, the second connecting line may open into the second low-temperature line, or vice versa. A valve is optionally arranged at the opening point. The above-mentioned control unit may be configured to actuate the at least one valve in order to set it as described.

As explained above, the low temperature heating mode is suitable above all for situations in which firstly the internal combustion engine has not or not yet been sufficiently heated, and in which also the ambient temperature is comparatively low. In situations in which the ambient temperature is however sufficiently high to make it unlikely that condensation water will form on mixing of aspirated fresh air and recirculated exhaust gas, heating the aspirated fresh air via the fresh air heat exchanger is unnecessary or even counter-productive. To take account of these cases, at least one valve may be adjustable in order, in a standard mode, to open a coolant flow between the charge air cooler and the low-temperature heat exchanger and to at least reduce the coolant flow through the first connecting line. In other words, in this standard mode, the coolant heated in the charge air cooler is to a certain extent cooled in the low-temperature heat exchanger in the conventional fashion, while in any case a reduced coolant supply takes place to the fresh air heat exchanger via the first connecting line. Here again, the term "reduced" should be understood in relation to a maximum possible size of coolant flow through the at least one valve which is normally assumed in low-temperature heating mode. The above-mentioned control unit may be configured to actuate the at least one valve in order to set it as described.

It is possible that significantly less heat is extracted from the coolant in the fresh air heat exchanger than is supplied to it in the charge air cooler. This would lead to an undesirable temperature increase and hence inadequate cooling of the charge air. To avoid this, according to an advantageous embodiment, it is provided that a third connecting line branches off the second connecting line and is connected at least indirectly to the low-pressure heat exchanger, wherein a thermostat unit is configured to influence a coolant flow through the third connecting line at least in low-temperature heating mode. The third connecting line may e.g. open into the above-mentioned first low-temperature line. Alternatively, it could be conducted directly to the low-temperature exchanger independently of the first low-temperature line. The thermostat unit may e.g. be arranged on the second connecting line at the point where the third connecting line branches off the second connecting line. The thermostat unit has at least one valve which can influence the coolant flow through the third connecting line. The valve may here be adjustable continuously or discontinuously; in the simplest case it can only block or open the coolant flow through the third connecting line. Qualitatively, the coolant flow is increased if the thermostat unit establishes an increased temperature inside the second connecting line. The thermostat unit could however also be designed in a more complex fashion and have several separate components, wherein for example a temperature sensor could be arranged remotely from said valve inside the second connecting line or even directly on the fresh air heat exchanger. Some control functions of the thermostat unit could also be performed by the above-mentioned control unit.

The engine system comprises a high-temperature cooling circuit for cooling the internal combustion engine. In such a high-temperature cooling circuit, a liquid coolant is used to cool the internal combustion engine, wherein for example separate cooling of a cylinder head on one side and an engine block on the other is possible. The coolant absorbs heat when passing through the internal combustion engine, or a coolant jacket thereof, whereby the internal combustion engine is cooled. Usually, this heat is transferred to a high-temperature heat exchanger which differs from the above-mentioned low-temperature heat exchanger. According to a further embodiment, a fourth connecting line connects the high-temperature cooling circuit at least indirectly to the fresh air heat exchanger downstream of the internal combustion engine, and at least one valve can be adjusted in order to open a coolant flow from the high-temperature cooling circuit to the fresh air heat exchanger via the fourth connecting line in a high-temperature heating mode. The high-temperature heating mode is suitable above all for situations in which the internal combustion engine is already sufficient heated, but the ambient temperature is so low that substantial condensation in the compressor region is to be feared unless the aspirated fresh air is heated. In these cases, the heat desired in the fresh air heat exchanger may be taken from the high-temperature cooling circuit. The above-mentioned control unit may be configured to actuate the at least one valve in order to set it as described. The coolant cooled in the fresh air heat exchanger is firstly discharged via the second connecting line. A fifth connecting line may branch off this, which is connected at least indirectly to the high-temperature heat exchanger.

The high-temperature cooling circuit necessarily has at least one first high-temperature line which runs from the internal combustion engine (or a water jacket thereof) to the high-temperature heat exchanger, and a second high-temperature line which runs from the high-temperature heat exchanger back to the internal combustion engine. A pump which ensures circulation of the liquid coolant in the high-temperature cooling circuit may be arranged in one of the two lines. This pump may either be coupled as a mechanical pump directly to the internal combustion engine, or it may be configured as an electric pump. Usually, in addition to said high-temperature lines, a high-temperature bypass line is provided which bypasses the high-temperature heat exchanger. This may for example branch off the first high-temperature line and open into the second high-temperature line, or it could be connected to the internal combustion engine independently of at least one of said high-temperature lines. Typically, an engine thermostat is provided which is arranged at a point at which the high-temperature bypass line branches off the first high-temperature line. The engine thermostat influences the ratio of the coolant flows through the high-temperature bypass line on one side and the first high-temperature line on the other. Qualitatively, the proportion of coolant through the high-temperature bypass line is increased if the coolant temperature in the first high-temperature line is high. According to one embodiment, the fourth connecting line branches off a high-temperature bypass line.

Optionally, in the low-temperature heating mode, the coolant flow through the fourth connecting line is at least reduced. In particular, the coolant flow through the fourth connecting line may be blocked. In this way, in particular a mixing of coolant from the high-temperature cooling circuit on one side and the low-temperature cooling circuit on the other side is prevented or minimized, which is generally advantageous.

For the same reason, it is desired that a coolant flow from the charge air cooler through the first connecting line is at least reduced in the high-temperature heating mode. In other words, in low-temperature heating mode, the fresh air heat exchanger is fully or mainly supplied with heat from the high-temperature cooler, while in high temperature heating mode, it is fully or mainly supplied with heat from the internal combustion engine (or its water jacket). It could be said that the fresh air heat exchanger may optionally be connected either to the high-temperature cooling circuit or to the low-temperature cooling circuit.

FIG. 1 shows a diagrammatic depiction of an engine system 1 with an internal combustion engine 2, e.g. a diesel engine or petrol engine of a motor vehicle. The internal combustion engine 2 is connected to a high-temperature heat exchanger 5 in a high-temperature cooling circuit 3. A liquid coolant, e.g. a water-glycol mixture, flows through a water jacket (not shown in more detail here) of the internal combustion engine 2 where it absorbs heat. Then it flows through an engine thermostat 6 to which a first high-temperature line 4 and a high-temperature bypass line 7 are connected. The first high-temperature line 4 opens into the high-temperature heat exchanger 5, which may for example be arranged behind a radiator grille of the motor vehicle. The coolant is there cooled by the ambient air. The cooled coolant is returned to the internal combustion engine 2 via a second high-temperature line 8 in which a first pump 9 is arranged. The first pump 9 may for example be mechanically coupled to the internal combustion engine 2. Alternatively, electric operation via a vehicle battery would also be conceivable. The high-temperature bypass line 7 bypasses the high-temperature heat exchanger 5 and opens into the second high-temperature line 8 downstream thereof. The engine thermostat 6 here regulates the proportion of coolant flow conducted through the first high-temperature line 4 and the high-temperature heat exchanger 5, and the proportion which is conducted through the high-temperature bypass line 7.

The internal combustion engine 2 is a charged engine to which compressed charge air is supplied by a compressor (shown in FIG. 5) of a turbocharger. Before being supplied to the internal combustion engine 2, the charge air heated in the compressor is cooled via a charge air cooler 11, which is connected to a low-temperature heat exchanger 14 in a low-temperature cooling circuit 10. A liquid coolant, which may be identical to that in the high-temperature cooling circuit 3, is used in the low-temperature cooling circuit 10. A first low-temperature line 12 leaves the charge air cooler 11 and opens into the low-temperature heat exchanger 14. A first valve 13 is arranged in the first low-temperature line 12. A second low-temperature line 15 runs from the low-temperature heat exchanger 14 back to the charge air cooler 11. A second pump 16, which conveys the coolant in the low-temperature cooling circuit 10, is arranged in the second low-temperature line 15. This is normally an electric pump.

In the engine system 1 shown, fresh air is drawn in from the environment of the vehicle and conducted via an intake line 20 in the direction of the compressor; an exhaust gas recirculation line or EGR line 27 opens into the intake line 20 at an exhaust gas recirculation valve or EGR valve 26. Via the EGR line 27, parts of the exhaust gases generated in the internal combustion engine 2 can be supplied, in some cases after catalytic treatment, to the internal combustion engine 2 again together with fresh air. A housing 21 with an air filter 22 is arranged in the intake line 20. Furthermore, a fresh air heat exchanger 23 is arranged inside the housing 21. A fresh air bypass line 25 leaves an intake air bypass valve 24 which is also arranged in the housing 21. Said line bypasses the fresh air heat exchanger 23 by branching off the intake line 20 upstream thereof and opening back into the intake line 20 downstream thereof.

The fresh air heat exchanger 23 is connected to the charge air cooler 11 via a first connecting line 30. In the exemplary embodiment shown here, the first connecting line 30 branches off the first low-temperature line 12. A second valve 33 is arranged in the first low-temperature line 30. Furthermore, the fresh air heat exchanger 23 is connected to the charge air cooler 11 via a second connection line 31, wherein in this exemplary embodiment, the second connection line 31 opens into the second low-temperature line 15 at a third valve 34. A thermostat 32 is arranged in the second connecting line 31, and from this thermostat a third connecting line 35 departs which opens into the first low-temperature line 12 between the first valve 13 and the low-temperature heat exchanger 14. Also, a fourth connecting line 36 leaves the high-temperature bypass line 7 and opens into the first connecting line 30 at the second valve 33. Finally, a fifth connecting line 37 leaves the second connecting line 31 and opens into the second high-temperature line 8.

FIG. 1 shows the engine system 1 in a standard mode. This may e.g. be assumed if the temperature of the external air, which is supplied via the intake line 20, is comparatively high. In this mode, the first valve 13 is open, the second valve 33 closed and the third valve 34 set such that at least the second low-temperature line 15 is open. Said valves 13, 33, 34 may be actuated via a control unit. Thus the high-temperature cooling circuit 3 and the low-temperature cooling circuit 10 may be operated separately, and there is no coolant flow to the fresh air heat exchanger 23. Fresh air is drawn in via the intake line 20, cleaned in the air filter 22, and finally—with substantially ambient temperature—reaches the EGR valve 26 where it is mixed with recirculated exhaust gases from the EGR line 27. The exhaust gases have a high temperature and contain moisture, condensation of which should be prevented as far as possible in order to avoid degradation to the compressor. Condensation could potentially occur on mixing with the cooler fresh air from the intake line 20. In standard mode as shown in FIG. 1, the temperature of the fresh air is however sufficiently high for moisture in the exhaust gases not to condense out.

Thus, in one example, FIG. 1 illustrates a first mode of the engine system 1, wherein the first valve 13 is adjusted to an open position, the second valve 33 is adjusted to a first second valve position, and the third valve 34 is adjusted to a first third valve position. The first second valve position is configured to block flow to the fresh air heat exchanger 23 from each of the first connecting line 30 and the fourth connecting line 36. The first third valve position is configured to allow coolant flow from the low-temperature heat exchanger 14 to the charge air cooler 11 via the second low-temperature line 15. The first third valve position may further be configured to block coolant flow from the thermostat 32 to the charge air cooler 11. As such, coolant flows in the high temperature circuit 3 and the low temperature circuit 10 may not mix during the first mode. The first mode further comprises where a temperature of fresh intake air is not adjusted via coolant flowing to the fresh air heat exchanger. As such, a likelihood of condensate formation may be less than a threshold likelihood, which is based on a temperature of the fresh air relative to a dew point temperature.

FIGS. 2 and 3 show the engine system 1 in different low-temperature heating modes. This may e.g. be assumed when the exterior temperature is below a specific value and the internal combustion engine 2 has not or has not yet reached a specified minimum temperature, e.g. on cold start. In this case, the first valve 13 is closed, the second valve 33 opens the first connecting line 30 but blocks the connection to the fourth connecting line 36, and the third valve 34 opens both the second connecting line 31 and the inlet for the second low-temperature line 15. Thus the coolant flow from the charge air cooler 11 to the low-temperature heat exchanger 14 through the first low-temperature line 12 is blocked. For this, a coolant flow from the charge air cooler 11 to the fresh air heat exchanger 23 via the first connecting line 30 is open. The coolant flows through the fresh air heat exchanger 23 and then flows back to the charge air cooler 11 via the second connecting line 31. Heating of the charge air results largely from compression in the compressor, and thus begins immediately after start-up of the internal combustion engine 2. Accordingly, the coolant in the charge air cooler 11 is also heated practically immediately after a cold start. It is supplied to the fresh air heat exchanger 23 via the first connecting line 30. Initially cooled fresh air flows onto this and is heated on contact with the fresh air heat exchanger 23 by the indirect thermal contact with the liquid coolant. In parallel, the liquid coolant is cooled and then returned through the second connecting line 31 and reheated in the charge air cooler 11. By heating the fresh air, a condensation of moisture on mixing with the recirculated exhaust gases can be avoided. If for example it is found that the fresh air is overheated or the coolant over-cooled in the fresh air heat exchanger 23, the fresh air bypass valve 24 can be fully or partially opened so that part of the fresh air bypasses the fresh air heat exchanger 23 through the fresh air bypass line 25.

Thus, the example of FIG. 2 illustrates a second mode of the engine system 1, wherein heating of the intake air is desired due to the likelihood of condensate formation be greater than the threshold likelihood. To mitigate and/or prevent condensate formation, the second mode includes heating the intake air by flowing heated coolant from the charge air cooler 11 to the fresh air heat exchanger 23. As such, the first valve 13 is moved to a fully closed position and block coolant flow from the charge air cooler 11 to the low temperature heat exchanger 14. The second valve 33 moves to a second second valve position, which comprises fluidly coupling the first connecting line 30 to the fresh air heat exchanger while sealing the high-temperature bypass line 7 from the fresh air heat exchanger. The third valve 34 is moved to a second third valve position which fluidly couples the second connecting line 31 to the charge air cooler 11. Thus, coolant flowing to the thermostat 32 does not enter the third connecting line 35 or the fifth connecting line 37.

However, it may also occur that the liquid coolant in the fresh air heat exchanger 23 is only inadequately cooled. This could adversely affect its function on return to the charge air cooler 11. This is blocked by the thermostat 32 and the third connecting line 35 connected thereto. If the thermostat 32 registers a coolant temperature above a specific limit value, it opens the access to the third connecting line 35 so that at least part of the coolant is supplied via this to the first low-temperature line 12 and hence to the low-temperature heat exchanger 14. Such a state is shown in FIG. 3. The low-temperature heat exchanger 14 thus to a certain extent supplements the cooling function of the fresh air heat exchanger 23. The coolant which was cooled in the low-temperature heat exchanger 14 is returned to the charge air cooler 11 via the second low-temperature line 15.

Thus, FIG. 3 illustrates a third mode of the engine system 1, wherein the third mode comprises coolant at the thermostat 32 comprises a temperature greater than a threshold temperature. In one example, the threshold temperature is based on a temperature where coolant may no longer sufficiently cool the compressed air in the charge air cooler 11. This may be due to insufficient cooling via the fresh air flow through the fresh air heat exchanger 23. The third mode comprises where the first valve is fully closed. The second valve is moved to the second second valve position. The third valve is moved to a third third valve position, wherein the third third valve position further allows coolant from the second low temperature line 15 to flow through the charge air cooler. That is to say, a portion of coolant at the thermostat 32 is directed to the low-temperature heat exchanger 14 via the third connecting line 35. As such, fresh air is heated by a combination of coolants from the high temperature coolant circuit 3 and the low temperature coolant circuit 10. Additionally or alternatively, a position of the thermostat 32 and/or the third valve 34 may be adjusted to adjust a blending between the coolant from the low temperature heat exchanger 14 and the coolant from the fresh air heat exchanger 23 such that a desired coolant temperature may be reached.

The low-temperature heating mode illustrated in FIGS. 2 and 3 is advantageous at low exterior temperatures and simultaneously unheated or inadequately heated internal combustion engine 2. If the exterior temperatures are low but the internal combustion engine 2 is adequately heated, alternatively the high-temperature heating mode shown in FIG. 4 may be used. Here, the first valve 13 is opened, the second valve 33 blocks the first connecting line 30 but opens the connection of the first connecting line 30 to the fourth connecting line 36, and the third valve 34 opens the second low-temperature line 15 but blocks the connection to the second connecting line 31. Thus the fresh air heat exchanger 23 is isolated from the low-temperature cooling circuit 10 but is supplied with heated coolant from the high-temperature cooling circuit 3 via the fourth connecting line 36 and the first connecting line 30. The coolant cools in the fresh air heat exchanger 23 and is conducted to the second high-temperature line 8 via the second connecting line 31 and the fifth connecting line 37, and thus returns to the high-temperature cooling circuit 3.

Thus, FIG. 4 illustrates a fourth mode of the engine system 1, wherein the fourth mode comprises where ambient temperatures are low but the engine 2 is outside of a cold start. That is to say, the engine 2 is hot and coolant from the engine may be advantageously used to heat the fresh air. As such, the first valve is fully opened and coolant from the charge air cooler 11 flows to the low temperature heat exchanger 14. The second valve 33 is moved to a third second valve position which allows coolant to flow from the fourth connecting line 36 to the first connecting line 30 to the fresh air heat exchanger 23. From the fresh air heat exchanger 23, the coolant flows through the second connecting line 31 to the fifth connecting line 37 and back to the engine via the second high temperature line 8. The third valve 34 is moved to the second third valve position, such that coolant from the low-temperature heat exchanger 14 flows to the charge air cooler 11. As such, the fresh air is heated via the high temperature coolant circuit 3 in the fourth mode and not via the low temperature coolant circuit 10. As such, in each of the first, second, third, and fourth modes, the high temperature coolant circuit 3 and the low temperature coolant circuit 10 do not mix coolant and remain fluidly separated from one another.

Turning now to FIG. 5, it shows a schematic depiction of a hybrid vehicle system 106 that can derive propulsion power from engine system 108 and/or an on-board energy storage device. An energy conversion device, such as a generator, may be operated to absorb energy from vehicle motion and/or engine operation, and then convert the absorbed energy to an energy form suitable for storage by the energy storage device. Engine 110 may be used similarly to the engine 2 of FIGS. 2 and 3.

Engine system 108 may include an engine 110 having a plurality of cylinders 130. Engine 110 includes an engine intake 124 and an engine exhaust 125. Engine intake 124 includes an air intake throttle 162 fluidly coupled to the engine intake manifold 144 via an intake passage 142. Air may enter intake passage 142 via air filter 152. Engine exhaust 125 includes an exhaust manifold 148 leading to an exhaust passage 135 that routes exhaust gas to the atmosphere. Engine exhaust 125 may include one or more emission control devices 170 mounted in a close-coupled position or in a far underbody position. The one or more emission control devices may include a three-way catalyst, lean NOx trap, selective catalytic reduction (SCR) device, particulate filter, oxidation catalyst, etc. It will be appreciated that other components may be included in the engine such as a variety of valves and sensors, as further elaborated in herein. In some embodiments, wherein engine system 108 is a boosted engine system, the engine system may further include a boosting device, such as a turbocharger comprising a turbine 180, a compressor 182, and a shaft 181 mechanically coupling the turbine 180 to the compressor 182. A charge-air cooler 183 is illustrated downstream of the compressor 182. In one example, the engine 110 and the charge-air cooler 183 are non-limiting examples of the engine 2 and charge air cooler 11 of FIGS. 1 to 4. A low-pressure EGR line 184 is configured to redirect a portion of exhaust gas from downstream of the turbine 180 to upstream of the compressor 182. In one example, the low-pressure EGR line 184 may be used similarly to the EGR line 27 of FIGS. 1-4.

Vehicle system 106 may further include control system 114. Control system 114 is shown receiving information from a plurality of sensors 116 (various examples of which are described herein) and sending control signals to a plurality of actuators 181 (various examples of which are described herein). As one example, sensors 116 may include exhaust gas sensor 126 located upstream of the emission control device, temperature sensor 128, and pressure sensor 129. Other sensors such as additional pressure, temperature, air/fuel ratio, and composition sensors may be coupled to various locations in the vehicle system 106. As another example, the actuators may include the throttle 162.

Controller 115 may be configured as a conventional microcomputer including a microprocessor unit, input/output ports, read-only memory, random access memory, keep alive memory, a controller area network (CAN) bus, etc. Controller 115 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In some examples, hybrid vehicle 106 comprises multiple sources of torque available to one or more vehicle wheels 159. In other examples, vehicle 106 is a conventional vehicle with only an engine, or an electric vehicle with only electric machine(s). In the example shown, vehicle 106 includes engine 110 and an electric machine 151. Electric machine 151 may be a motor or a motor/generator. A crankshaft of engine 110 and electric machine 151 may be connected via a transmission 154 to vehicle wheels 159 when one or more clutches 156 are engaged. In the depicted example, a first clutch 156 is provided between a crankshaft and the electric machine 151, and a second clutch 156 is provided between electric machine 151 and transmission 154. Controller 115 may send a signal to an actuator of each clutch 156 to engage or disengage the clutch, so as to connect or disconnect crankshaft from electric machine 151 and the components connected thereto, and/or connect or disconnect electric machine 151 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 151 receives electrical power from a traction battery 161 to provide torque to vehicle wheels 159. Electric machine 151 may also be operated as a generator to provide electrical power to charge battery 161, for example during a braking operation.

Turning now to FIG. 6, it shows a method 600 for selecting one of the first, second, third, or fourth modes in response to a temperature of a low-temperature coolant circuit coolant, a high-temperature coolant circuit coolant, and a fresh air. Instructions for carrying out method 600 may be executed by a controller based on instructions stored on a memory of the controller and in conjunction with signals received from sensors of the engine system, such as the sensors described above with reference to FIG. 5. The controller may employ engine actuators of the engine system to adjust engine operation, according to the methods described below.

The method 600 begins at 602, which includes determining current engine operating parameters. Current engine operating parameters may include but are not limited to one or more of a manifold vacuum, throttle position, engine temperature, engine speed, vehicle speed, ambient temperature, and air/fuel ratio.

The method 600 proceeds to 604, which includes determining if a cold-start is occurring. The cold-start may be occurring if an engine temperature is less than a desired engine temperature. In one example, the desired engine temperature is a temperature range from 180 to 220° F.

If the cold-start is not occurring, then the method 600 proceeds to 606, which includes determining if a condensate likelihood is greater than a threshold likelihood. The condensate likelihood may be based on one or more of a fresh air temperature, an intake pipe temperature, and ambient conditions, such as a humidity level.

If the condensate likelihood is not greater than the threshold likelihood, then the method 600 proceeds to 608, which includes entering the first mode. The first mode comprises where the first valve is adjusted to an open position at 610, the second valve is adjusted to a first second valve position at 612, and the third valve is adjusted to a first third valve position at 614. The first second valve position is configured to block flow to the fresh air heat exchanger from each of the first connecting line and the fourth connecting line. The first third valve position is configured to allow coolant flow from the low-temperature heat exchanger to the charge air cooler via the second low-temperature line. The first third valve position may further be configured to block coolant flow from the thermostat to the charge air cooler. As such, coolant flows in the high temperature circuit and the low temperature circuit may not mix during the first mode. The first mode further comprises where a temperature of fresh intake air is not adjusted via coolant flowing to the fresh air heat exchanger. Furthermore, coolant from each of the high temperature and low temperature coolant circuits are blocked from flowing to the fresh air heat exchanger during the first mode.

The method 600 proceeds to 616, which includes continuing to monitor coolant and ambient temperatures. In one example, the method 600 is configured to continue selecting between the first, second, third, and fourth modes as coolant and ambient temperatures change.

Returning to 606, if the condensate likelihood is greater than the threshold likelihood, then the method 600 proceeds to 618, which includes entering the fourth mode. The fourth mode comprises where ambient temperatures are low but the engine is outside of a cold start. That is to say, the engine is hot and coolant from the engine may be advantageously used to heat the fresh air while also cooling the engine coolant. As such, the first valve is fully opened and coolant from the charge air cooler flows to the low temperature heat exchanger. The second valve is moved to the third second valve position which allows coolant to flow from the fourth connecting line to the first connecting line to the fresh air heat exchanger. From the fresh air heat exchanger, the coolant flows through the second connecting line to the fifth connecting line and back to the engine via the second high temperature line. The third valve is moved to the second third valve position, such that coolant from the low-temperature heat exchanger flows to the charge air cooler. As such, the fresh air is heated via the high temperature coolant circuit in the fourth mode and not via the low temperature coolant circuit. The method 600 proceeds to 616, as described above.

Returning to 604, if a cold-start is occurring, then the method 600 proceeds to 627 to determine the condensate likelihood, identical to 606 described above. If the condensate likelihood is not greater than the threshold likelihood, then the method 600 proceeds to 608 to enter the first mode as the cold-start is occurring. If the condensate likelihood is occurring, then the method 600 proceeds to 628, which includes determining if a coolant temperature of the low-temperature coolant circuit is less than a threshold temperature. In one example, the threshold temperature is based on an amount of desired cooling provided to compressed air.

If the coolant temperature is not less than the threshold temperature and compressed air is not being sufficiently cooled, then the method 600 proceeds to 630 to enter the third mode. The third mode comprises where coolant at the thermostat comprises a temperature greater than the threshold temperature. This may be due to insufficient cooling via the fresh air flow through the fresh air heat exchanger. The third mode comprises where the first valve is fully closed. The second valve is moved to the second second valve position. The third valve is moved to a third third valve position, wherein the third third valve position further allows coolant from the second low temperature line to flow through the charge air cooler. That is to say, a portion of coolant at the thermostat is directed to the low-temperature heat exchanger via the third connecting line. As such, fresh air is heated by a combination of coolants from the high temperature coolant circuit and the low temperature coolant circuit. Additionally or alternatively, a position of the thermostat and/or the third valve may be adjusted to adjust a blending between the coolant from the low temperature heat exchanger 14 and the coolant from the fresh air heat exchanger 23 such that a desired coolant temperature may be reached.

Returning to 628, if the coolant temperature is less than the threshold temperature, then the method 600 proceeds to 638, which includes entering the second mode. The second mode includes heating the intake air by flowing heated coolant from the charge air cooler to the fresh air heat exchanger. As such, the first valve is moved to a fully closed position and block coolant flow from the charge air cooler to the low temperature heat exchanger. The second valve moves to a second second valve position, which comprises fluidly coupling the first connecting line to the fresh air heat exchanger while sealing the high-temperature bypass line from the fresh air heat exchanger. The third valve is moved to a second third valve position which fluidly couples the second connecting line to the charge air cooler. Thus, coolant flowing to the thermostat does not enter the third connecting line or the fifth connecting line.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

In this way, an engine system comprises a coolant arrangement configured to heat intake air during conditions where condensate may form. The technical effect of the cooling arrangement is to remove the need for an auxiliary heating device while decreasing a condensate likelihood. As such, a compressor longevity may be increased and a manufacturing cost may be reduced.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine system with an internal combustion engine, an intake line comprising a fresh air heat exchanger, an exhaust gas recirculation line opening into the intake line upstream of a compressor and downstream of the fresh air heat exchanger, and a charge air cooler arranged downstream of the compressor, wherein the charge air cooler is fluidly coupled to the fresh air heat exchanger via a first connecting line, and wherein the charge air cooler flow coolant through the first connecting line to the fresh air heat exchanger via a first valve, a second valve, and a third valve.

2. The engine system of claim 1, wherein a fresh air bypass line configured to bypass the fresh air heat exchanger is coupled to the intake line upstream and downstream of the fresh air heat exchanger, wherein an air flow ratio between the intake line and the fresh air bypass line is adjusted by at least one fresh air bypass valve.

3. The engine system of claim 1, wherein the charge air cooler is fluidly coupled to a low-temperature heat exchanger via a first low temperature line, wherein the first valve is to reduce a coolant flow from the charge air cooler to the low-temperature heat exchanger.

4. The engine system of claim 3, wherein a second low temperature line is configured to flow coolant from the low-temperature heat exchanger to the charge air cooler, wherein the third valve is configured to adjust coolant flow from the low-temperature heat exchanger to the charge air cooler.

5. The engine system of claim 4, wherein a first connecting line fluidly couples the charge air cooler to the fresh air heat exchange, and wherein the second valve is configured to adjust a coolant flow from the charge air cooler to the fresh air heat exchanger.

6. The engine system of claim 5, wherein the third valve is further configured to adjust a coolant flow through a second connecting line, wherein the second connecting line is configured to flow coolant from the fresh air heat exchanger to the charge air cooler.

7. The engine system of claim 5, wherein the second connecting line further comprises a thermostat configured to adjust coolant flow through each of the second connecting line and a third connecting line, wherein the third connecting line is fluidly coupled to the low temperature heat exchanger.

8. A method, comprising:

selecting a first mode in response to a condensate likelihood not being greater than a threshold likelihood, wherein the first mode comprises adjusting a first valve to an open position, a second valve to a first second valve position, and a third valve to a first third valve position;

selecting a second mode in response to each of the condensate likelihood being greater than a threshold likelihood, a cold-start occurring, and a coolant temperature being less than a threshold temperature, wherein the second mode comprises adjusting the first valve to a closed position, the second valve to a second second valve position, and the third valve to a second third valve position;

selecting a third mode in response to each of the condensate likelihood being greater than the threshold likelihood, the cold-start occurring, and the coolant temperature not being less than the threshold temperature, wherein the third mode comprises adjusting the first valve to the closed position, the second valve to the second second valve position, and the third valve to a third third valve position; and selecting a fourth mode in response to the condensate likelihood being greater than the threshold likelihood and the cold-start not occurring, wherein the fourth mode comprises adjusting the first valve to the open position, the second valve to a third second valve position, and the third valve to the second third valve position.

9. The method of claim 8, wherein the first mode further comprises flowing coolant from a charge air cooler, through the open position of the first valve, to a low temperature heat exchanger, and wherein the second valve in the first second valve position blocks coolant from the charge air cooler from flowing to a fresh air heat exchanger, further comprising flowing coolant from the low temperature heat exchanger through the third valve in the first third valve position to the charge air cooler.

10. The method of claim 8, wherein the second mode further comprises flowing coolant from a charge air cooler to a fresh air heat exchanger via the second valve in the second second valve position, further comprising flowing coolant from the fresh air heat exchanger to the charge air cooler via the third valve in the second third valve position, and wherein the first valve in the closed position blocks coolant flow from the charge air cooler to a low temperature heat exchanger.

11. The method of claim 8, wherein the third mode further comprises flowing coolant from the charge air cooler to a fresh air heat exchanger via the second valve in the second second valve position, further comprising flowing coolant from the fresh air heat exchanger to a thermostat configured to direct coolant to a low temperature heat exchanger and the third valve, further comprising flowing coolant from the thermostat and the low temperature heat exchanger through the third valve in the third third valve position to the charge air cooler.

12. The method of claim 8, wherein the fourth mode further comprises flowing coolant from the charge air cooler, through the first valve in the open position to a low temperature heat exchanger, and wherein the fourth mode further comprises flowing coolant from a high-temperature bypass line of an engine coolant circuit, through the third second valve position, and to the fresh air heat exchanger.

13. The method of claim 8, wherein the first mode further comprises blocking coolant flow from a high temperature coolant circuit and a low temperature coolant circuit to a fresh air heat exchanger, wherein the fresh air heat exchanger is arranged in a housing with an air filter.

14. The method of claim 13, wherein the second mode and the third mode further comprise blocking coolant flow from the high temperature coolant circuit to the fresh air heat exchanger, and wherein the second mode and the third mode further comprise flowing coolant from the low-temperature coolant circuit to the fresh air heat exchanger.

15. The method of claim 13, wherein the fourth mode further comprises flowing coolant from the high temperature coolant circuit to the fresh air heat exchanger, the fourth mode further comprises blocking coolant from the low temperature coolant circuit to the fresh air heat exchanger.

16. The method of claim 13, further comprising blocking mixing between coolants of the high temperature coolant circuit and the low temperature coolant circuit.

17. A system, comprising:

a charge air cooler fluidly coupled to a low temperature heat exchanger via a low temperature line, wherein coolant flow through the low temperature line is adjusted via a first valve, and wherein the charge air cooler is fluidly coupled to a fresh air heat exchanger via a first connecting line, wherein a second valve is configured to adjust coolant flow through the first connecting line, and wherein a second connecting line is configured to flow coolant from the fresh air heat exchanger to the charge air cooler, and wherein a third valve is configured to adjust coolant flow through the second connecting line.

18. The system of claim 17, wherein the low temperature line is a first low temperature line, further comprising a second low temperature line configured to flow coolant from the low temperature heat exchanger to the charge air cooler, wherein the third valve is configured to adjust coolant flow through the second low temperature line to the charge air cooler.

19. The system of claim 17, wherein the fresh air heat exchanger is configured to allow fresh air to flow therethrough and thermally communicate with coolant therein without mixing fresh air and coolant.

20. The system of claim 17, wherein the second valve is further configured to adjust a coolant flow from a high temperature bypass line of a high temperature coolant circuit to the fresh air heat exchanger, wherein the charge air cooler and the low temperature heat exchanger are arranged in a low temperature coolant circuit, and wherein coolant from the high temperature coolant circuit and the low temperature coolant circuit do not mix.

* * * * *